US006588312B2

(12) United States Patent
Murello et al.

(10) Patent No.: US 6,588,312 B2
(45) Date of Patent: Jul. 8, 2003

(54) AUTOMATIC FIREARM WITH A BOLT ASSEMBLY THAT MOVES BETWEEN A CLOSED POSITION AND AN OPEN POSITION

(75) Inventors: Johannes Murello, Deisslingen (DE); Wilhelm Fischbach, Deisslingen-Laufen (DE); Helmut Weldle, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/916,763

(22) Filed: Jul. 27, 2001

(65) Prior Publication Data

US 2002/0020284 A1 Feb. 21, 2002

Related U.S. Application Data

(63) Continuation of application No. PCT/EP00/00599, filed on Jan. 25, 2000.

(51) Int. Cl.[7] ..... F41A 9/23
(52) U.S. Cl. ..... 89/197; 89/33.1
(58) Field of Search ..... 89/194, 195, 196, 89/197, 33.1

(56) References Cited

U.S. PATENT DOCUMENTS

| | | | | | |
|---|---|---|---|---|---|
| 2,659,994 A | * | 11/1953 | Yale | | |
| 3,054,206 A | | 9/1962 | Raleigh | | |
| 3,120,070 A | | 2/1964 | Reed | | |
| 3,123,927 A | | 3/1964 | Katz | | |
| 4,391,055 A | * | 7/1983 | Kadim | ..... | 42/50 |
| 4,567,810 A | * | 2/1986 | Preston | ..... | 89/142 |

FOREIGN PATENT DOCUMENTS

| | | | | | |
|---|---|---|---|---|---|
| DE | 181871 | * | 4/1907 | ..... | 89/194 |
| DE | 532615 | | 8/1931 | | |
| DE | 1811246 | | 11/1969 | | |
| EP | 0 319 261 | * | 6/1989 | ..... | 89/196 |

OTHER PUBLICATIONS

International Search Report for parent PCT Application No. PCT/EP00/00599, report dated May 29, 2000.

* cited by examiner

*Primary Examiner*—Stephen M. Johnson
(74) *Attorney, Agent, or Firm*—Marshall, Gerstein & Borun

(57) ABSTRACT

An automatic firearm with a bolt assembly which is moveable along a bolt assembly motion path between a closed position and an open position, a magazine which advances cartridges by spring force across the bolt assembly motion path into this motion path, and a lock which only allows the first cartridge of magazine to advance into the bolt assembly motion path when the bolt assembly is situated in or near its open position, is disclosed. The lock is preferably created by a plate that extends parallel to the bolt assembly motion path and is mobile in its direction of extent, is pushed between the first cartridge and the bolt assembly motion path, and holds back the cartridge until the bolt assembly has reached or almost reached its open position.

14 Claims, 4 Drawing Sheets

A - A
A
A
7
4
15
21
13
19
23

AUTOMATIC FIREARM WITH A BOLT ASSEMBLY THAT MOVES BETWEEN A CLOSED POSITION AND AN OPEN POSITION

CROSS-REFERENCE TO RELATED APPLICATION

This application is a continuation of and claims priority under 35 USC §120 from PCT Application Ser. No. PCT/EP00/00599, filed Jan. 25, 2000.

FIELD OF THE INVENTION

The invention concerns an automatic firearm with a bolt assembly that moves along a motion path between a closed position and an open position with a magazine that conveys, by spring force or the like, cartridges in sequence into an advance position across the motion path of the bolt assembly, in which the first or uppermost cartridge protrudes at least partially into the bolt assembly motion path.

BACKGROUND OF THE INVENTION

As used herein, when position terms like "top", "vertical" or the like are used, a weapon in the normal firing position is always assumed in which the barrel is horizontal. Similarly, "forward" is in the direction of shooting. Examples of automatic weapons are disclosed in U.S. Pat. Nos. 3,054,206; 3,120,070; 3,123,927; German Patent Nos. 532615 and 1811246; and French Patent No. 461816.

In automatic weapons of the type just mentioned, for example, with a clip magazine, the first or uppermost cartridge is forced by the magazine spring against the bolt assembly or behind the bolt assembly in its motion path when the bolt assembly is in the closed position. If, as a result of firing, the bolt assembly returns to its open position, it rubs against the uppermost cartridge until it approaches its open position. Only in such a position can the uppermost cartridge be advanced into its advance position. In this position, it is held by at least one magazine lip and is situated at least partly in front of the bolt assembly.

If the bolt assembly then moves forward again into its closed position, it pushes the cartridge from the rear into the cartridge chamber, in which the cartridge follows a more or less pronounced zig-zag path. This zig-zag path is flatter, the farther the advance position is situated in the motion path of the bolt assembly. The flatter this zig-zag, the more gentle the transport of the cartridge and the lower the likelihood of jamming. However, the first cartridge is also forced more vigorously by the magazine spring against the moving bolt assembly. If the cartridge is mechanically sensitive, say, a shotgun cartridge with a cardboard casing, it can be damaged during reloading. This is one of the reasons why automatic hunting shotguns employ a tubular magazine which conveys the first cartridge onto a loading spoon, on which it lies loosely beneath the moved bolt assembly and only then pivots into the motion path of the bolt assembly when it is open. Automatic shotguns for police use, on the other hand, which have a clip magazine, cannot fire such sensitive ammunition free of disturbance for this reason.

A generic automatic weapon is also a drawback for sports shooters who repeatedly reload a spent cartridge casing. The bolt assembly sliding along the pushed cartridge necessarily scratches its casing and damages it so that it can be reloaded less often than, say, the casing of a cartridge that is fired from a single-shot weapon.

Scratching of the projectile in a sharpshooter's weapon can lead to a reduction in shooting accuracy. This scratching of the projectile and casing is particularly serious when the bolt head has downward protruding sharp-edged protrusions and projections, like the US M16 military weapon.

So-called intelligent ammunition has recently been developed. This is ammunition for firearms whose projectile accommodates electronics that influence the behavior of the fired projectile. Thus, it is possible by means of target electronics mounted on the weapon to communicate to a spin-stabilized projectile the distance at which it is to detonate on firing. The target electronics then determines the distance to the target and informs the projectile of the number of revolutions that it must execute up to the target. The projectile electronics counts the actual projectile revolutions and ignites an explosive charge on reaching the stipulated number. In this ammunition the cartridge casing accounts for only about 40% of the cartridge length. The projectile equipped with the electronics has a length of about ⅔ of the cartridge length. The projectile shell need not serve as twisting guide and fragment shell in this projectile, but merely as covering. A plastic ring on the rear of the projectile, which also offers sealing relative to the propellant, like a propellant reflector, causes twist guiding. This type of projectile shell is naturally sensitive to mechanical damage.

The described projectile is sensitive in another respect: it cannot always be avoided that the bolt mechanism, which consists of steel, will become slightly permanently magnetic with time. In its material selection, the mechanical properties have absolute priority over any magnetic properties. The hazard of bolt mechanism magnetization exists, especially after longer storage of the weapon, in an arsenal in which the bolt mechanism lies for a longer time with unchanged alignment in the earth's magnetic field. Noticeable permanent magnetization can occur because of this. If this bolt mechanism is more or less strongly magnetized and moved directly past the projectile, it can induce interfering voltages in the projectile electronics. These can adversely affect the electronics. It is expressly pointed out that the invention concerns only those automatic weapons in which the first cartridge is still situated in the magazine in its advance position, i.e., a position in order to be introduced directly into the cartridge chamber of the barrel. Automatic weapons are known in which the advance position of the first cartridge does not coincide with its uppermost position in the magazine. In such weapons, the first cartridge, for example, is initially conveyed by means of an additional mechanism into a waiting position and only then into the advance position after removal from the magazine or a belt.

SUMMARY OF THE INVENTION

Starting from the problem outlined above, the underlying task of the disclosed apparatus is to modify the automatic firearm mentioned at the outset so that the cartridge, especially the projectile, retains its integrity as much as possible during reloading. It would also be advantageous to reduce any effect of a possible magnetized bolt assembly on a projectile with electronics.

This task is solved according to the disclosed apparatus since the automatic firearm mentioned at the outset has a lock releasable by the bolt mechanism, which initially holds back the first cartridge before it enters the motion path of the bolt assembly and is only released by the bolt assembly to advance this cartridge when the bolt assembly approaches its rear end position or open position.

Because of this, the bolt assembly can return without touching the cartridge to be advanced next or without scratching it. Only when the bolt assembly has traveled past the cartridge, at least its projectile, is the cartridge released by the lock, snaps upward into the advance position and can then be grasped by the bolt assembly moving forward again and reloaded. The cartridge in the weapon according to the disclosed apparatus does not lie against the bolt assembly during return of the bolt assembly, but is spaced from it, if only by a limited amount. This limited distance, however, can be sufficient to adequately reduce any magnetic influences of the bolt assembly on the projectile electronics.

BRIEF DESCRIPTION OF THE DRAWINGS

The operation of the disclosed apparatus is further explained with reference to a practical example in conjunction with the enclosed schematic drawing. In the drawing.

DETAILED DESCRIPTION OF THE PREFERRED EMBODIMENTS

The reference numbers are the same for identical elements of both arrangements.

If such elements are not marked in one of the figures or are not explained in the description of one of the figures, the designation or description in another figure applies.

Figure 1:
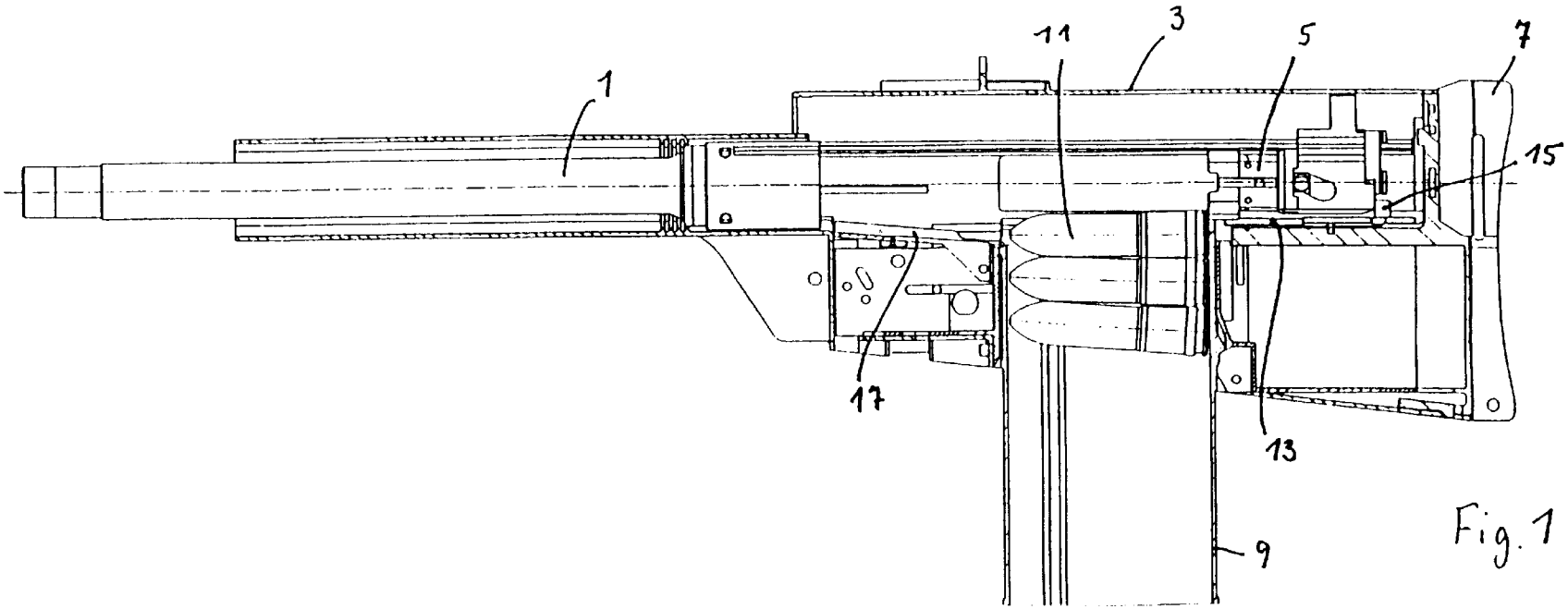
FIG. 1 shows a cross section through an automatic weapon according to the invention with an open bolt assembly in which the grip and hand guard have been left out in the interest of simplicity, with a separate arrangement for guiding a "cartridge-protecting" plate.
Figure 2:
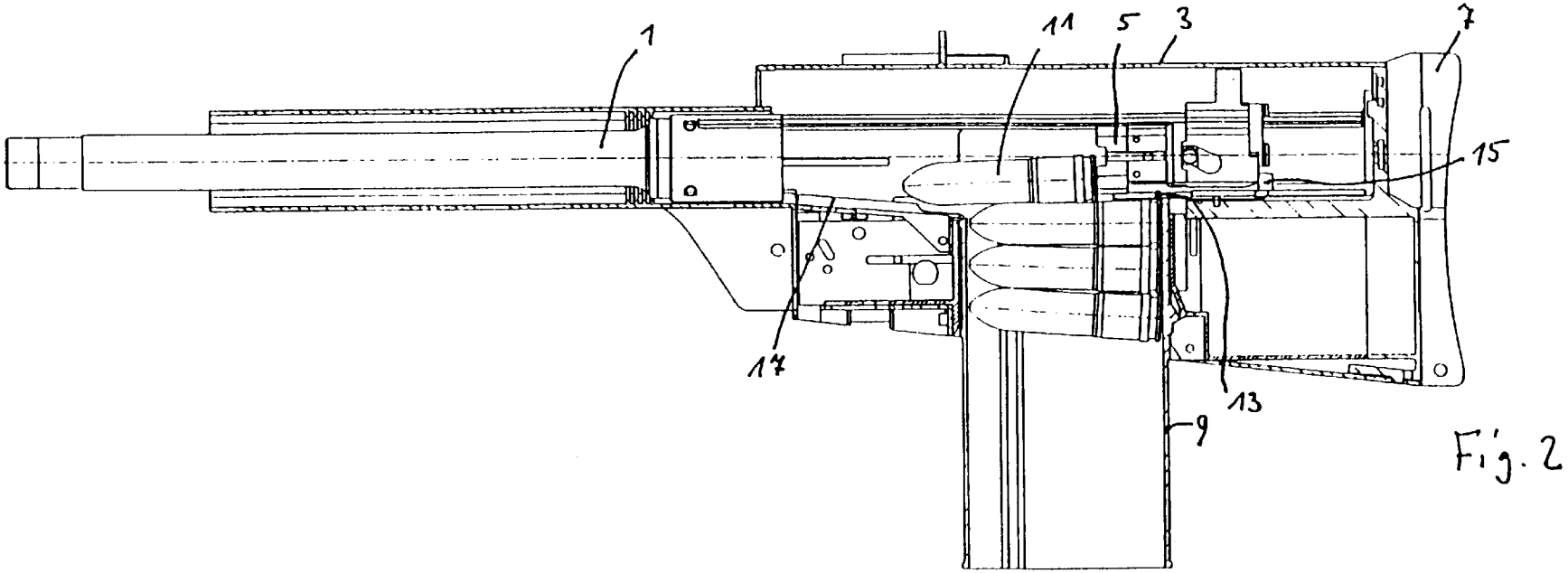
FIG. 2 shows a cross section similar to that of FIG. 1, but with the bolt assembly traveling forward.
Figure 3:
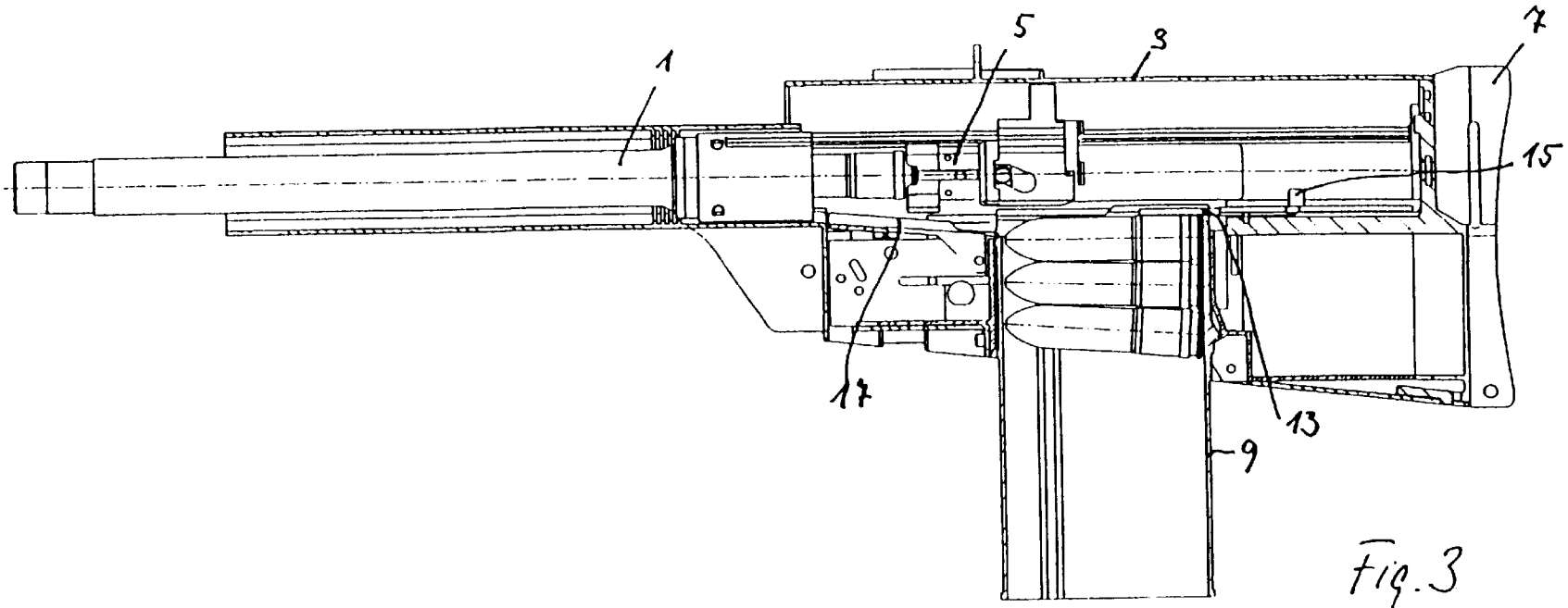
FIG. 3 shows a cross section similar to that of FIG. 1, but in which the bolt assembly has just passed above the magazine and introduced a cartridge into the cartridge chamber.
Figures 4, 5, 6, 7:
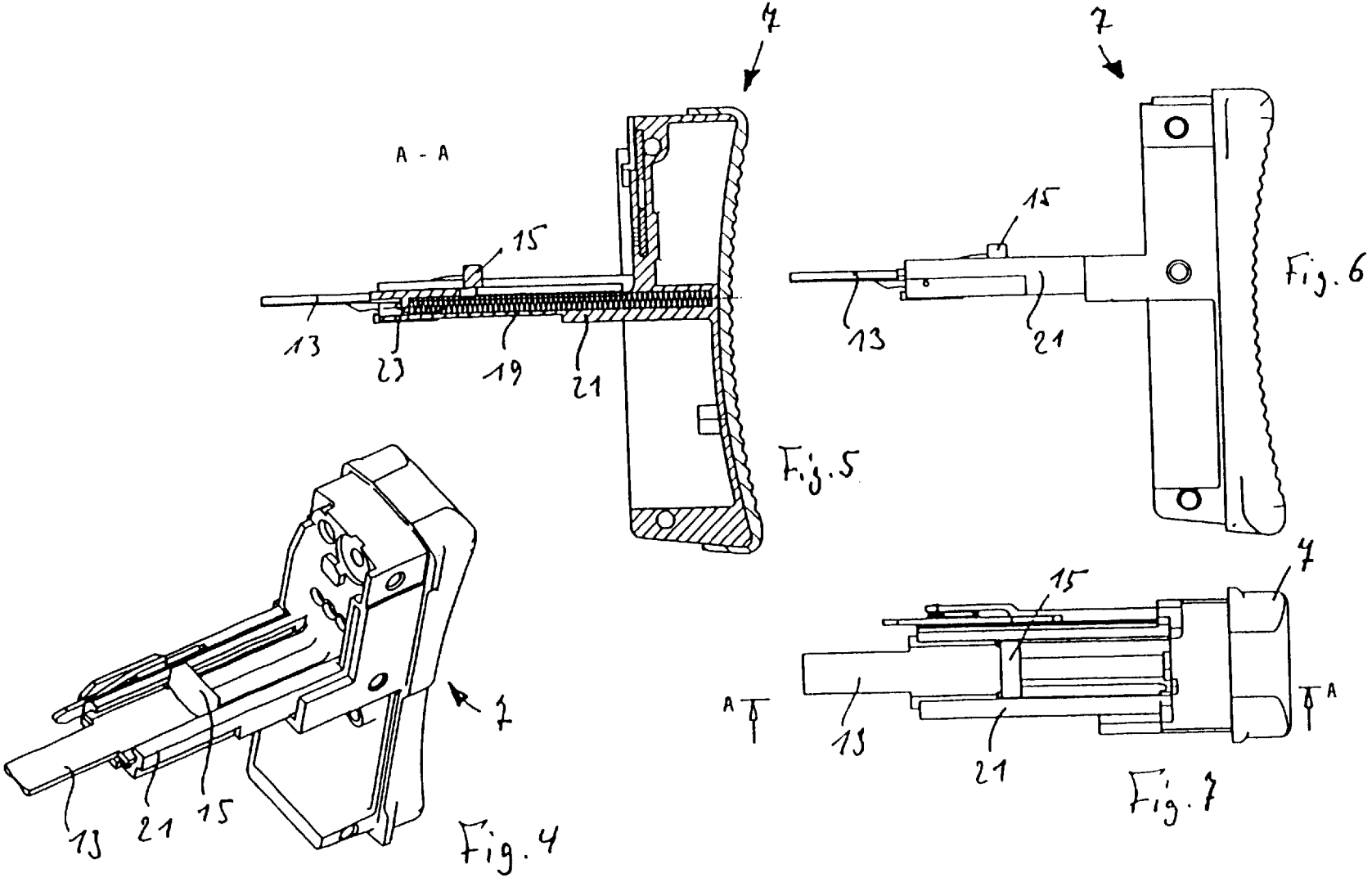
FIG. 4 shows the end cap integrated with the plate and guide in an oblique view.
FIG. 5 shows a longitudinal section through the elements depicted in FIG. 4 along line A—A in FIG. 7.
FIG. 6 shows a side view through the elements depicted in FIG. 4.
FIG. 7 shows a top view of the elements depicted in FIG. 4.

A large caliber automatic weapon in the first variant is shown schematically and in cross section in FIGS. 1 to 3 with the grip being removed for better clarity.

A weapon housing 3 carries on its front end a barrel 1 and on its rear end an end cap 7. The motion path of a bolt assembly 5 is formed between the rear end of the barrel and the inside of the end cap 7, the bolt assembly sitting on the rear end of the barrel in its front position (not shown) and moveable against the force of a recoil spring (not shown, above the bore axis) into its rear position (FIG. 1). The motion path of the bolt assembly 5 runs roughly parallel to the bore axis or center axis of barrel 1. During rearward movement, an empty cartridge casing is extracted from barrel 1 and ejected laterally (perpendicular to the plane of the figure). During forward movement of the bolt assembly, the first or uppermost cartridge 11 is grasped in magazine 9 (FIG. 2) and introduced into barrel 1.

Magazine 9 in this practical example is designed as a straight clip magazine and extends roughly perpendicular to the motion path of the bolt assembly 5. Several cartridges are accommodated in it and are forced upward by spring force by a feed mechanism (not shown) against the motion path of the bolt assembly 5. The first cartridge 11 assumes an advance position on the uppermost end of magazine 9. In this position, it protrudes (from below) into the motion path of the bolt assembly 5 (FIG. 1) so that it can be grasped by its front end surface and pushed forward. The first cartridge 11 then passes with its projectile tip over a flat ramp 17, then executes a flat zig-zag movement forward and upward (FIG. 2) and is finally introduced into the cartridge chamber of barrel 1 (FIG. 3).

In a second variant, a guide 21 (FIGS. 4 to 7) with two lateral grooves facing each other is formed on the end cap 7, into which a flat, elongated protective plate 13 is inserted to move longitudinally with its long edges. A receiving hole for a coil compression spring 19 is formed in the bottom of guide 21, which also extends parallel to the motion path of bolt assembly 5.

This spring 19 is supported with its rear end on the end cap 7 and with its front end on a transverse lug 23 (FIG. 5), which is formed on the bottom of protective plate 13. The spring 19 therefore loads the protective plate 13 forward and is compressed when the protective plate 13 is moved rearward.

On the rear end of protective plate 13, an upward protruding contact piece 15 is formed which engages behind bolt assembly 5 in the assembled weapon.

The guide can be designed in one piece with the end cap 7 or consist of separate parts that are optionally incorporated separately in the weapon housing 3. In the depicted example (FIGS. 4 to 7), the guide 21 consists of a part integrated in the end cap.

The end cap 7, the guide 21 and optionally the protective plate 13 are made from plastic and optionally reinforced with fibers and/or inserts, perhaps steel.

The depicted practical example functions as follows:

When the bolt assembly 5 is closed, the rest position of the protective plate 13 is as shown in FIG. 3: it covers the cartridge casing of the first cartridge 11 in magazine 9 from the rear and thus keeps the entire cartridge 11 beneath the motion path of bolt assembly 5. Since the first cartridge 11 is supported from below by another cartridge or the feed mechanism of magazine 9, it is aligned on the protective plate 13 and cannot tilt upward with the projectile. The projectile can therefore maintain a limited spacing to bolt assembly 5.

After firing, the bolt assembly 5 travels back and strikes against the contact piece 15. The bolt assembly 5 at this point has already lost its high initial speed, since it is braked by the recoil spring (not shown) during return. It is also almost fully covered on the bottom by the protective plate 13. Only the bolt head, i.e., the front part of the bolt assembly 5, protrudes slightly above the front transverse edge of protective plate 13.

On further return, the bolt assembly 5 entrains the protective plate 13 rearward. As soon as the protective plate 13 and the bolt head have passed fully over the first cartridge 11 rearward, this cartridge can jump upward into the advance position. This position is shown in FIG. 1.

Finally, the bolt assembly 5 reaches its rear end position. It is then accelerated again forward, in which the spring 19 also pushes the protective plate 13 forward again. The contact piece 15 therefore remains engaged with the back side of bolt assembly 5. Whereas the first cartridge 11 is now pushed forward by bolt assembly 5, it initially runs along the magazine lips (not shown) and therefore remains roughly at the height of the advance position. The protective plate 13 follows the forward movement of bolt assembly 5 and is pushed between it and the next cartridge. This stage is shown in FIG. 2.

The first cartridge 11 now slides over the very long and therefore very flat ramp 17 into the cartridge chamber of barrel 1. The protective plate 13 has already reached its front end position beforehand and remains there so that the contact piece 15 remains opposite bolt assembly 5. The next cartridge in magazine 9 can advance upward but only up to protective plate 13. This position is shown in FIG. 3. As is readily apparent in this figure, the uppermost contour line of the projectile of this now uppermost cartridge has a significant spacing from the lower edge of the bolt head moving above it. The bolt assembly 5 can never reach the sensitive projectile or move against it. The reloading function of the weapon is not adversely affected in any way.

It is possible in principle to design the lock already within the magazine or engaging in it, for example, by means of a locking protrusion that engages laterally in the magazine through an opening in its wall. However, the lock is preferably designed as a plate that extends parallel to the motion path of the bolt assembly, is moveable in the direction of its extent between a locking position and a release position and in its locking position comes to lie between the bolt assembly and the first cartridge. This plate holds back the first cartridge lying against it but does not damage it. For this purpose, the plate is preferably designed smooth on its side facing the cartridge. The plate therefore serves to protect the cartridge.

An automatic weapon that fires the aforementioned intelligent ammunition is designed very large because the employed cartridge has a caliber of about 20 mm. The weight that an automatic weapon may have, however, is restricted. The disclosed apparatus unexpectedly leads to a weight reduction here: previously the bolt mechanism of an automatic weapon had to have a smooth surface on its bottom so as not to damage the cartridge and not to hang up on it. It therefore had a solid, web-like shoulder on its bottom that did not contribute to its actual function of closing the cartridge chamber during firing. The bolt assembly can therefore be reduced to its functionally essential weight-optimized design and therefore be significantly reduced in weight. The plate for protecting the first cartridge, on the other hand, can be designed from a thin and/or light material so that overall a weight reduction of the weapon is gained. Even in automatic weapons for much smaller cartridges a weight reduction is always sought. Here, the advantage of weight reduction according to the disclosed apparatus has a less significant effect than in the aforementioned large-caliber automatic weapons. On the other hand, the disclosed apparatus has a similar weight-reducing effect as in the large caliber automatic weapons in automatic shotguns with a clip magazine.

This locking or protective plate could be guided loosely and have a catch for its active position that holds back the first cartridge and an additional catch for its inactive position that releases the first cartridge. However, the plate could also be fastened to the bolt assembly. However, it is preferably independent of it and has a spring that forces it into its active position. In addition, the plate engages in the motion path of the bolt assembly, for example with a protrusion or the like, so that it is carried along by the bolt assembly during its return. In this case, this spring supports the recoil spring connected to the bolt assembly at least during opening of the bolt assembly.

The plate can extend over the entire top of the magazine and because of this could additionally prevent large foreign objects from entering the bolt mechanism motion path when the magazine is removed and the bolt assembly closed. The plate consists of an electrically conducting but nonmagnetizable material and can additionally serve as a magnetic shielding of the already mentioned intelligent ammunition relative to the magnetized bolt assembly.

However, it is particularly advantageous if the plate in its locking position only overlaps part of the cartridge and especially only the cartridge casing or (in a shotgun) the metal casing that forms the end of the cartridge casing. The plate then extends from the rear edge of the magazine forward and ends in front of the front magazine edge, in which it can be retracted rearward from the bolt assembly until the first cartridge is released.

In the mentioned intelligent ammunition, this expedient has the particular advantage that the plate cannot touch the projectile and is also not situated in its vicinity. It is therefore possible to design the plate from steel without having to fear an inductive effect on the projectile electronics. Moreover, the bolt assembly during return only entrains the plate when it has already been substantially braked by the recoil spring. The plate therefore slides over the cartridge casing only with limited speed and therefore limited intensity.

It is also possible in addition to or instead of this to design the plate from a nonferrous metal, especially a light metal, or even a plastic. In precisely the last named case, not only is a weight savings obtained, but also particularly gentle treatment of the first cartridge that lies against the plate. It cannot be ruled out that the plate will acquire a burr from rough and improper handling, which could damage the cartridge. The possibility of a burr is almost ruled out when using an appropriate plastic. Nor would it damage the cartridge to the extent that a burr of a metal plate would. This choice of appropriate plastic is easily possible for anyone skilled in the art. The plastic can also be applied as a coating to a metal plate.

In order to minimize the possibility of damage to the plate during disassembly and cleaning of the weapon, it is particularly advantageous to arrange the plate with its spring and guide on the side of the end cap of the weapon housing that faces its inside.

"End cap" in a weapon of the bullpup design is understood to mean the rear end cap of the weapon housing that is supported on the shoulder of the shooter. In a weapon of the bullpup design, the otherwise common rear shaft is omitted, the weapon housing extends up to the shoulder of the shooter and is closed there by the end cap. The grip is situated in front of the magazine. Moreover, the scope of the invention is not restricted to weapons of the bullpop design.

To remove the bolt assembly, the end cap is initially removed together with the entire arrangement for guiding the plate, in which its engagement with the bolt assembly can be loosened.

It is to be understood that the above description does not limit the invention to the above-given details. It is contemplated that various modifications and substitutions can be made without departing from the spirit and scope of the following claims.

What is claimed is:

1. An automatic firearm, comprising:

a bolt assembly moving along a motion path between a closed position and an open position;

a magazine which conveys by spring force cartridges in sequence into an advance position across the bolt mechanism motion path, in which each cartridge protrudes at least partially into the bolt assembly motion path;

a lock releasable by the bolt assembly, which holds back the first cartridge from entering the bolt assembly motion path and is only released for advance of the first cartridge by the bolt mechanism when the latter is situated substantially in the open position, the lock being designed as a plate which extends parallel to the bolt assembly motion path, is movable in the direction of its extent between a locked position and a released position, and which in its locked position comes to lie between the bolt assembly and the first cartridge; and a spring which loads the plate from its released position into its locked position, and where the plate has a contact piece that engages in the bolt assembly motion path, and which can be carried along by the bolt assembly during its movement to its open position, the plate overlapping essentially only the cartridge casing of the first cartridge when in its locked position.

2. The automatic firearm of claim 1, wherein the plate comprises a slide-promoting plastic.

3. The automatic firearm of claim 1, wherein the plate comprises a slide-promoting plastic.

4. The automatic firearm of claim 1, wherein the plate comprises a slide-promoting plastic.

5. An automatic firearm, comprising:

a bolt assembly moving along a motion path between a closed position and an open position;

a magazine which conveys by spring force cartridges in sequence into an advanced position across the bolt assembly motion path in which each cartridge protrudes at least partially into the bolt assembly motion path;

a lock releasable by the bolt assembly, which holds back the first cartridge when entering the bolt assembly motion path and is only released for advance of the first cartridge by the bolt assembly when the latter is situated substantially in the open position, the lock being designed as a plate which extends parallel to the bolt assembly motion path, is movable in the direction of its extent between a locked position and a released position, and in its locked position comes to lie between the bolt assembly and the first cartridge;

a spring which loads the plate from its released position into its locked position, wherein the plate has a contact piece that engages in the bolt assembly motion path, and which can be carried along by the bolt assembly during its movement to its open position;

a weapon housing containing said plate and said spring; and an end cap closing the weapon housing rearward and designed to be supported on a shoulder of a shooter, and wherein the plate and spring are accommodated to move in a guide on the end cap.

6. A method of operating an automatic firearm, comprising:

providing a bolt assembly axially slidable through a housing in a first direction between a barrel and an end cap;

providing a cartridge magazine adapted to direct cartridges toward the housing in a second direction transverse to the first direction;

pushing one of the cartridges from the magazine into the housing when the bolt assembly is proximate the end cap; and placing a lock between the cartridge pushed into the housing and a remainder of cartridges in the magazine while the bolt assembly is advanced from the end cap to the barrel and back to the end cap, the lock including a plate adapted to overlie a casing of the cartridge in the magazine.

7. The method of claim 6, wherein the lock is a plate adapted to extend parallel to the bolt mechanism motion path.

8. The method of claim 7, wherein a spring is employed to place the plate between the cartridge pushed into the housing and the remainder of cartridges.

9. The method of claim 8, wherein the end cap further includes a guide in which the plate is adapted to slide.

10. The method of claim 6, wherein the plate is made of plastic.

11. The method of claim 6, wherein the plate is made of a nonferrous metal.

12. An automatic firearm, comprising:

a housing having a barrel and an end cap;

a bolt assembly slidable within the housing along a bolt assembly motion path between the barrel and the end cap;

a magazine mounted to the housing and adapted to contain a plurality of cartridges, the cartridges being biased toward the bolt assembly motion path in a first direction, the first direction being substantially perpendicular to the bolt assembly motion path; and means for preventing contact between the bolt assembly and casings of the cartridges including a plate slidable to a locking position between the magazine and the bolt assembly motion path.

13. An automatic firearm, comprising:

a housing having a barrel and an end cap;

a bolt assembly slidable within the housing along a bolt assembly motion between the barrel and the end cap;

a magazine mounted to the housing and adapted to contain a plurality of cartridges, the cartridges being biased to the bolt assembly motion path in a first direction, the first direction being substantially perpendicular to the bolt assembly motion path;

means for preventing contact between the bolt assembly and sides of the cartridge, the means for preventing including a plate slidable to a locking position between the magazine and the bolt assembly motion path; and a guide extending from the end cap, the plate being slidable through the guide.

14. The automatic firearm of claim 13 further including a spring within the guide biasing the plate toward the locking position.

* * * * *